US007479055B2

(12) United States Patent
Saeki

(10) Patent No.: US 7,479,055 B2
(45) Date of Patent: Jan. 20, 2009

(54) RUNNING DEVICE FOR MODEL, AND MODEL AND REMOTE CONTROL TOY HAVING THE RUNNING DEVICE

(75) Inventor: Kazuyuki Saeki, Tokyo (JP)

(73) Assignee: Konami Corporation, Tokyo (JP)

( * ) Notice: Subject to any disclaimer, the term of this patent is extended or adjusted under 35 U.S.C. 154(b) by 624 days.

(21) Appl. No.: 10/510,187

(22) PCT Filed: Jul. 26, 2004

(86) PCT No.: PCT/JP2004/010984

§ 371 (c)(1),
(2), (4) Date: Nov. 23, 2004

(87) PCT Pub. No.: WO2005/009572

PCT Pub. Date: Feb. 3, 2005

(65) Prior Publication Data

US 2006/0154563 A1 Jul. 13, 2006

(30) Foreign Application Priority Data

Jul. 29, 2003 (JP) ..... 2003-282128

(51) Int. Cl.
*A63H 30/00* (2006.01)

(52) U.S. Cl. ..... 446/454; 446/437

(58) Field of Classification Search ..... 446/454–456, 446/465, 437

See application file for complete search history.

(56) References Cited

U.S. PATENT DOCUMENTS 4,355,482 A * 10/1982 Sapkus et al. ..... 446/279

(Continued)

FOREIGN PATENT DOCUMENTS

EP 1231580 8/2002

(Continued)

OTHER PUBLICATIONS

Patent Abstracts of Japan for JP4-43268-Y2 published on Oct. 13, 1992.

(Continued)

*Primary Examiner*—Robert E Pezzuto
*Assistant Examiner*—Alex F. R. P. Rada, II
(74) *Attorney, Agent, or Firm*—Darby & Darby

(57) ABSTRACT

In a running device for a model (6) comprising a pair of motors (7), a pair of left and right wheels (8) which are independently driven by the pair of motors (7), and a control device (20) which controls operations of the pair of motors (7) based on instructions concerning speed and direction, the control device (20) controls the pair of motors (7) such that the pair of motors (7) are alternately rotated in an instructed direction when the instructed speed (Vm) is in a low speed range (L, M), and the pair of motors (7) are rotated in the instructed direction simultaneously when the instructed speed is in a high speed range (H) which is higher than the low speed range.

14 Claims, 8 Drawing Sheets

CASE OF SPEED RANGE L

CASE OF SPEED RANGE M

U.S. PATENT DOCUMENTS

| | | | | | |
|---|---|---|---|---|---|
| 5,135,427 | A | * | 8/1992 | Suto et al. | 446/433 |
| 5,667,420 | A | * | 9/1997 | Menow et al. | 446/433 |
| 6,024,627 | A | * | 2/2000 | Tilbor et al. | 456/456 |
| 7,303,459 | B2 | * | 12/2007 | Yamaguchi | 446/454 |

FOREIGN PATENT DOCUMENTS

| | | | |
|---|---|---|---|
| JP | 4-43268 | Y2 | 10/1992 |
| JP | 11-333150 | A | 12/1999 |
| JP | 2003-53055 | A | 2/2003 |

OTHER PUBLICATIONS

Patent Abstracts of Japan for JP2003-053055 published on Feb. 25, 2003.

Patent Abstracts of Japan for JP11-333150 published on Dec. 7, 1999.

International Search Report in Japanese for PCT/JP2004/010984 mailed Oct. 26, 2004.

* cited by examiner

FIG. 2

| ID CORD | OPERATION INFO. OF LEFT STICK | OPERATION INFO. OF RIGHT STICK |
|---|---|---|

CASE OF SPEED RANGE L

CASE OF SPEED RANGE M

CASE OF SPEED RANGE H

RUNNING DEVICE FOR MODEL, AND MODEL AND REMOTE CONTROL TOY HAVING THE RUNNING DEVICE

This is a U.S. national phase application under 35 U.S.C. §371 of International Patent Application No. PCT/JP2004/010984 filed Jul. 26, 2004, and claims the benefit of Japanese Patent Application No. 2003-282 128 filed Jul. 29, 2003 which is incorporated by reference herein. The International Application has not published as of the date of filing of this application.

TECHNICAL FIELD OF THE INVENTION

The present invention relates to a running device for a model which is suitably used for a remote control toy and the like.

BACKGROUND OF THE INVENTION

As a running device for a model incorporated in a model of a remote control toy, there are known running devices in which a pair of left and right wheels are driven by separate motors, and a running direction of the model is changed according to a speed difference between the motors (see Japanese Patent Applications Laid-open Nos. 2002-238083 and 2003-053055).

SUMMARY OF THE INVENTION

In the case of the conventional running device, speeds of the motors are simply made different from each other when the running direction of the model is to be changed, and when the model is to be allowed to run straightly, the left and right motors are driven at equal speed. This structure is convenient when the model is modeled after an automobile or the like, but the structure can not sufficiently express a state in which a human or an animal walks on two legs (two-leg-walking, hereinafter).

Thereupon, it is an object of the present invention to provide a running device capable of realizing a running motion including characteristics of the two-leg-walking by using the structure of driving left and right wheels independently, and a model and a remote control toy using the running device.

One embodiment of the present invention solves the above problems using the following means:

The first running device for a model includes a pair of motors, a pair of left and right wheels which are independently driven by the pair of motors, and a driving control device which controls operations of the pair of motors respectively based on instructions concerning speed and direction, the driving control device controls the pair of motors such that the pair of motors are alternately rotated in an instructed direction when an instructed speed is in a low speed range, and the pair of motors are rotated in an instructed direction simultaneously when an instructed speed is in a high speed range which is higher than the low speed range.

According to the first running device for a model, when the speed in the low speed region is instructed, the left and right wheels are alternately rotated so that the model moves in the instructed direction while meandering laterally. Thus, it is possible to express as if the model walks such that the model alternately projects the two legs while swinging the body of the model laterally. On the other hand, when the speed in the high speed region is instructed, such a lateral swinging motion is eliminated, and it is possible to express the state in which the model moves straightly in the instructed direction.

In this manner, it is possible to realize the distinctive running including the characteristics of the two-leg-walking as compared with a case in which the speed is simply increased or reduced.

In the first running device for a model according to an embodiment of the invention, if the instructed speed is changed from a low speed side to a high speed side in the low speed range, the driving control device may shorten a period for switching rotations of the motors as compared with the period in the low speed side. As the period for switching rotations of the motors is shorter, the lateral swinging motion of the model is carried out at a higher pitch. Thereby, it is possible to more appropriately express a state in which the model is in a hurry.

The second model running device comprises a pair of motors, a pair of left and right wheels which are independently driven by the pair of motors, and a driving control device which controls operations of the pair of motors respectively based on instructions concerning speed and direction, the driving control device controls the pair of motors such that the motors are alternately rotated in an instructed direction, and controls such that if an instructed speed is changed from a low speed side to a high speed side, a period for switching rotations of the motors is shortened as compared with the period in the low speed side.

In the second model running device also, by alternately rotating the left and right wheels, it is possible to express as if the model walks such that the model alternately projects the two legs while swinging the body of the model laterally. Further, if the instructed speed is changed from the low speed side to the high speed side, the period for switching the rotations of the motors becomes shorter than that in the low speed side, and thereby the lateral swinging motion of the model is carried out at higher pitch. Thus, it is possible to express a state in which the model slowly walks while swinging its body laterally in the low speed side, and the model walks at high pitch in the high speed side.

In each of the running devices for models according to an embodiment of the invention, as the instructed speed is higher, the driving control device may increase the rotation speed of the motor which is being driven. By combining the increase and decrease in speed, difference between slow motion and quick motion concerning the movement of the model can be expressed more clearly.

Further, the running device for a model according to an embodiment of the invention can suitably be used for a model which is modeled after a two-leg-walking type organism or machine. If the running device for a model is applied to such a model, the appearance of the model and running characteristics thereof are combined, and it is possible to strongly give the impression that the model is walking in the two-leg-walking manner to users.

The first remote control toy according to an embodiment of the invention includes a controller and a model, the controller generating and sending a control signal corresponding to operation of a user, the model having a running device to be remotely controlled based on the control signal, the running device includes a pair of motors, a pair of left and right wheels which are independently driven by the pair of motors, and a driving control device which controls operations of the pair of motors respectively based on instructions concerning the speed and direction specified according to the control signal, the driving control device controls the pair of motors such that the pair of motors are alternately rotated in an instructed direction when an instructed speed is in a low speed range, and the pair of motors are rotated in an instructed direction simultaneously when an instructed speed is in a high speed range which is higher than the low speed range.

According to the first remote control toy, since the toy has the first model running device, the manner of moving the model can be changed between the case in which the low speed is instructed and the case in which the high speed is instructed. Thus, it is possible to realize the distinctive running including the characteristics of the two-leg-walking as compared with a case in which the speed is simply increased or reduced.

In the first remote control toy, if the instructed speed is changed from a low speed side to a high speed side in the low speed range, the driving control device may shorten a period for switching rotations of the motors as compared with the period in the low speed side.

The second remote control toy according to an embodiment of the invention includes a controller and a model, the controller generating and sending a control signal corresponding to operation of a user, the model having a running device to be remotely controlled based on the control signal, the running device includes a pair of motors, a pair of left and right wheels which are independently driven by the pair of motors, and a driving control device which controls operations of the pair of motors respectively based on instructions concerning the speed and direction specified according to the control signal, the driving control device controls the pair of motors such that the motors are alternately rotated in an instructed direction, and controls such that if an instructed speed is changed from a low speed side to a high speed side, a period for switching rotations of the motors is shortened as compared with the period in the low speed side.

According to the second remote control toy, since the toy includes the second model running device, the period of the swinging motion of the model in the high speed side is set shorter than that in the low speed side, and it is possible to express a state in which the model slowly walks while swinging its body laterally in the low speed side, and the model walks at high pitch in the high speed side.

In the remote control toy according to another embodiment of the invention, as the instructed speed is higher, the driving control device may increase the rotation speed of the motor being driven, and the model may be modeled after a two-leg-walking type organism or machine. Merits obtained from these structure are as explained in the explanation of the running device for a model.

As explained above, according to an embodiment of the present invention, a state in which the left and right wheels are alternately rotated and a state in which the wheels are rotated simultaneously are used properly, or the period during which the rotations of the left and right wheels are switched is changed. Thus, it is possible to express as if the model walks such that the model alternately projects the two legs while swinging the body of the model laterally, and the moving manner can be changed according to the instructed speed. Therefore, the model can obtain the running motion which is similar to the two-leg-walking by utilizing the structure in which the left and right wheels are independently driven.

BRIEF DESCRIPTION OF THE DRAWINGS

FIG. 2 shows one example of a control signal sent from a controller;

BEST MODE FOR CARRYING OUT THE INVENTION

Figure 1:
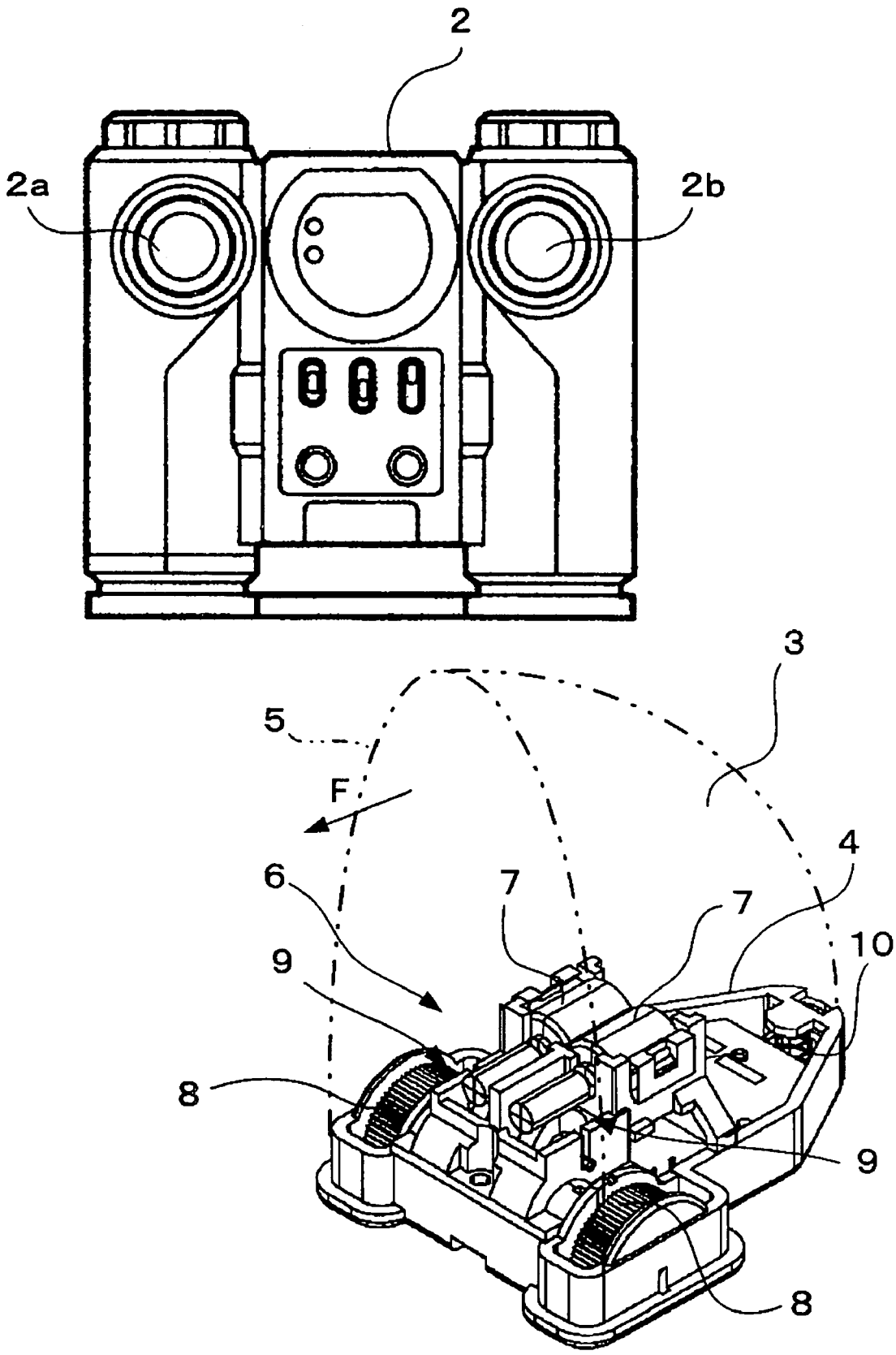
FIG. 1 is a schematic view of a remote control toy to which an embodiment of the present invention is applied.

FIG. 1 shows one mode of a running device for a model according to an embodiment of the present invention, which is applied to a remote control toy 1. The remote control toy 1 includes a controller 2 and a model 3. The controller 2 includes a left stick 2*a* and a right stick 2*b* as operation members which are operated by a user to allow the model 3 to run. The left stick 2*a* is operated in the vertical direction in FIG. 1 from a predetermined neutral position for instructing a running direction and speed of the model 3. The right stick 2*b* is operated in the lateral direction in FIG. 1 from the predetermined neutral position for laterally changing the moving direction of the model 3. The controller 2 includes, therein, a control device (not shown) comprising a microcomputer. The control device sends a control signal for judging operation states of the sticks 2*a* and 2*b* by predetermined carrier wave. The control signal has a structure shown in FIG. 2 for example. In this example, the control signal includes operation information of the left and right sticks 2*a* and 2*b* following ID cord by which a corresponding relationship between the controller 2 and the model 3 is judged. The operation information includes both information for judging the operation direction from the neutral position of each of the sticks 2*a* and 2*b*, and information for judging the number of operation steps from the neutral position. For example, the number of operation steps of each of the sticks 2*a* and 2*b* is eight, wherein the neutral position of each of the sticks 2*a* and 2*b* is defined as 0, the maximum operation step of each stick is defined as 8, and the eight operation steps are located on each of the both sides of the neutral positions. The carrier wave onto which the control signal is superposed may be infrared rays or radio wave.

Referring back to FIG. 1, the model 3 includes a chassis 4 and a cover 5 for covering the chassis 4. The cover 5 has an appearance which is modeled after a two-leg-walking type organism or machine. A front surface of the cover 5 is directed toward the arrow F in FIG. 1. A running device 6 is mounted on the chassis 4. The running device 6 includes a pair of motors 7, a pair of wheels 8 disposed left and right front ends of the chassis 4, and a pair of power transmitting mechanisms 9 for transmitting powers of the motors 7 to the wheels 8 independently. The chassis 4 is provided at its rear end with a support portion 10 which supports a rear end of the model 3.

Figure 3:
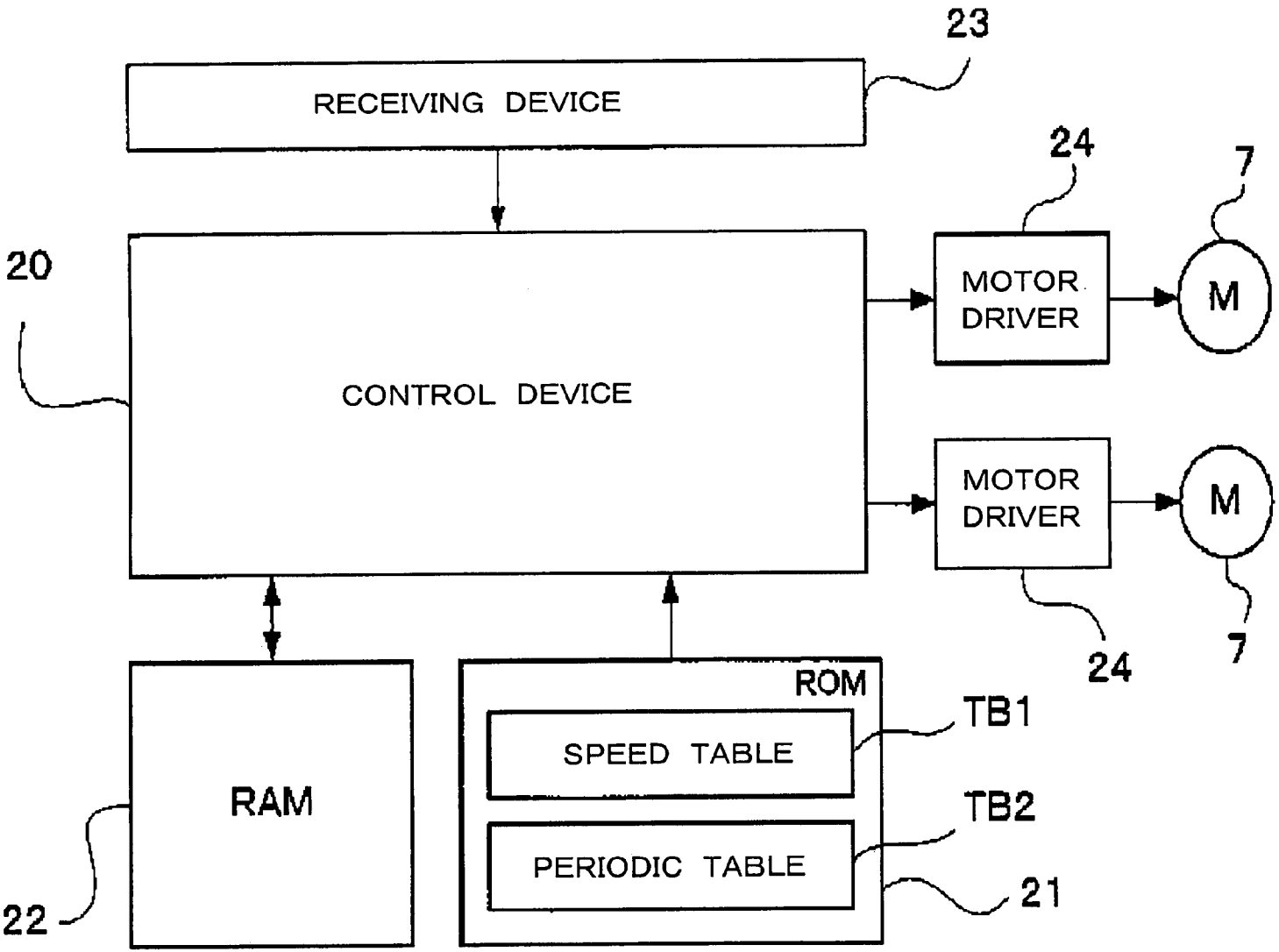
FIG. 3 is a block diagram of a control system for allowing a model shown in FIG. 1 to run.

FIG. 3 shows a structure of a control system for allowing the model 3 to run. The model 3 includes a control device 20 comprising a microcomputer, a ROM 21 and a RAM 22 which function as main memories of the control device 20, a receiving device 23 which receives a control signal sent from the controller 2 and converts the control signal into a signal that can be read by the control device 20, and a pair of motor drivers 24 which rotate the motors 7 at speed and in a direction corresponding to a speed signal sent from the control device 20. The control device 20 functions as a driving-control device of the running device 6. Interfaces between the hardware are not shown in the drawing.

Figure 4:
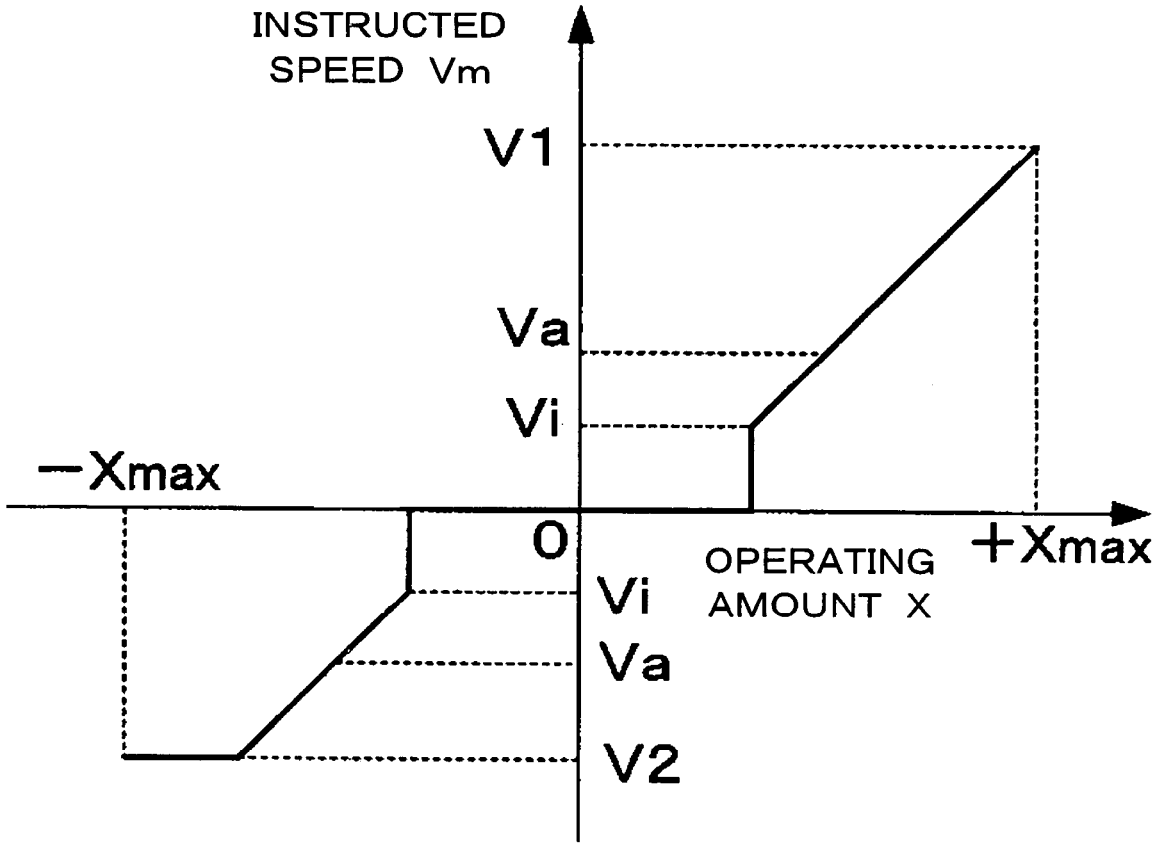
FIG. 4 is a graph showing contents of a speed table which is referred to by the control system shown in FIG. 3.

In order to determine the rotation speed and the rotation direction of the motor 7 based on the control signal sent from the controller 2, a speed table TB1 and a periodic table TB2 are stored in the ROM 21. In the speed table TB1, an operating amount X of the left stick 2*a* and instructed speed Vm of the motor 7 are described as data in association with each other as shown in FIG. 4 for example. Signs (positive and negative signs) of the operating amount X in FIG. 4 show the operating direction of the left stick 2*a*, the positive sign shows the operating direction (upward in FIG. 1) when the model 3 is moved forward, and the negative sign shows the operating direction (downward in FIG. 1) when the model 3 is moved backward. Signs (positive and negative signs) of the instructed speed Vm in FIG. 4 show the rotation direction of the motor 7, the positive sign shows the rotation direction (normal direction, hereinafter) when the model 3 is moved forward, and the negative sign shows the rotation direction (reverse direction, hereinafter) when the model 3 is moved backward. In the following description, the operating amount X and the instructed speed Vm means absolute values in FIG. 4 unless otherwise specified.

In the example shown in FIG. 4, the instructed speed Vm is held at 0 until the operating amount X reaches a given value in the positive direction (upward in FIG. 1), and if the operating amount X exceeds the given value, the instructed speed Vm proportionally increases in the positive direction in accordance with the increase of the operating amount X. If the operating amount X reaches the maximum value Xmax in the positive direction, the instructed speed Vm reaches the maximum value V1 in the normal direction. On the other hand, the instructed speed Vm is held at 0 until the operating amount X reaches the given value in the negative direction (downward in FIG. 1), and if the operating amount X exceeds the given value, the instructed speed Vm proportionally increases in the negative direction in accordance with the increase of the operating amount x. Here, the instructed speed Vm is fixed to the maximum value V2 (V2<V1) in the reverse direction before the operating amount X reaches the maximum value Xmax in the negative direction. The instructed speed Vm can be adjusted one step by one step from 0 indicative of a stop state to the maximum value V1.

Figure 5:
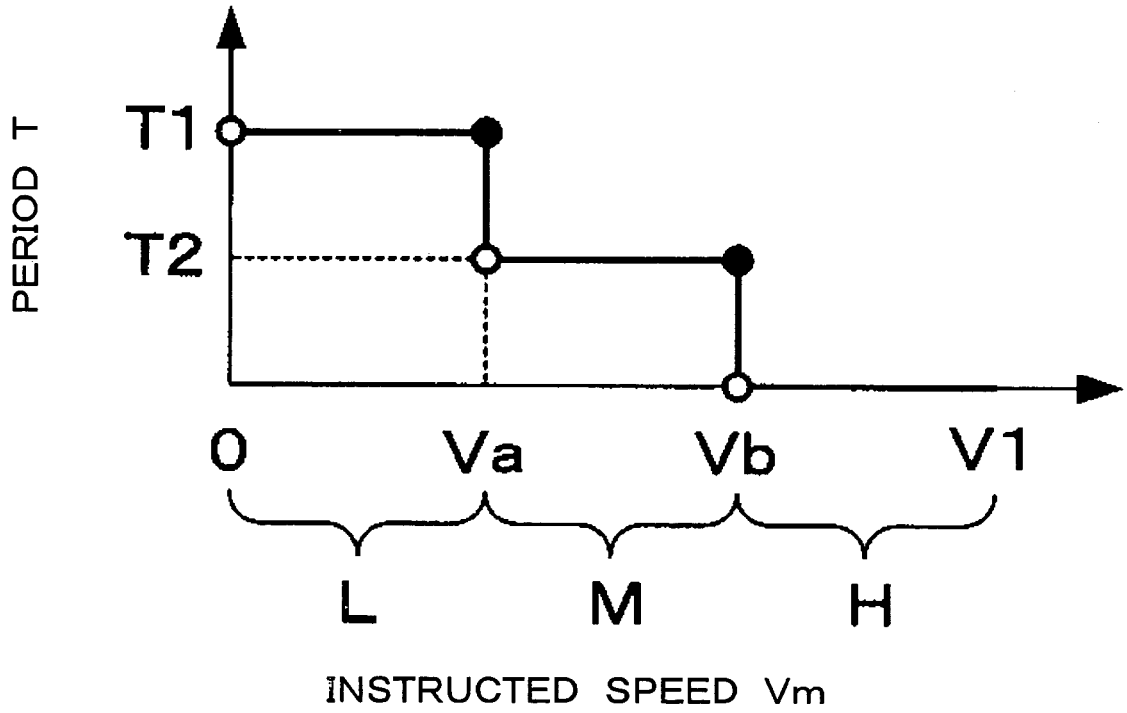
FIG. 5 is a graph showing contents of a periodic table which is referred to by the control system shown in FIG. 3.

On the other hand, in the periodic table TB2, the instructed speed Vm and period T during which rotation and stop of the motor 7 are repeated are described as data in association with each other as shown in FIG. 5 for example. In this example, when the instructed speed Vm is in a speed range L to be greater than 0 and equal to or smaller than Va, the period T assumes the maximum value T1, and when the instructed speed Vm is in a speed range M to exceed Va and be equal to or smaller than Vb, the period T assumes an intermediate value T2 which is somewhat smaller than period T, and when the instructed speed Vm is in a speed range H to exceed Vb and be equal to or smaller than the maximum value V1, the period T becomes 0. In the relationship with FIG. 4, the upper limit value Vi of the speed range L is greater than an initial speed V1 at the moment when the operating amount X exceeds the given value and the instructed speed Vm rises.

Figure 6:
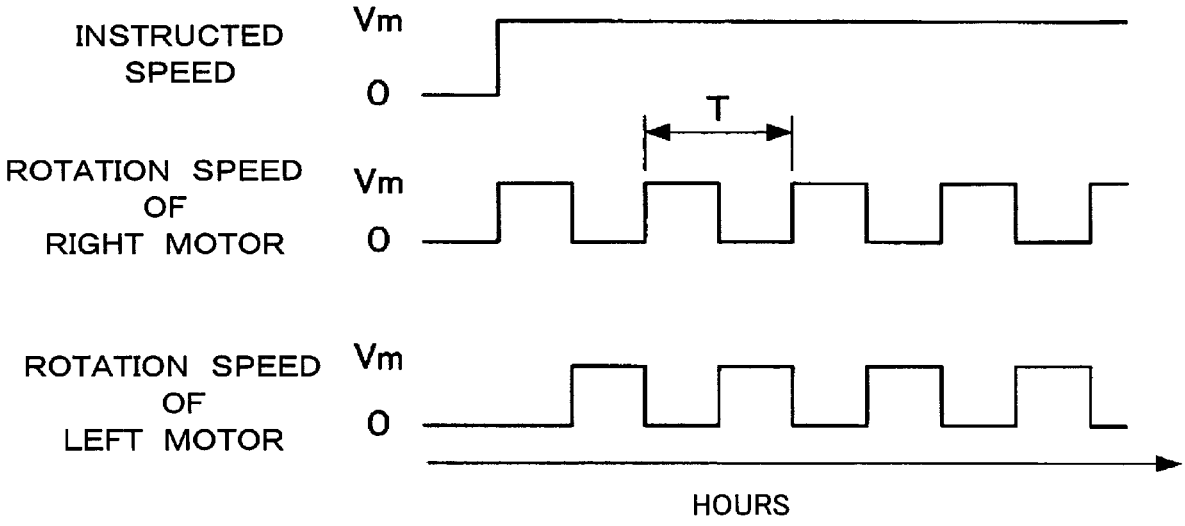
FIG. 6 shows one example of a corresponding relationship between instructed speed and period obtained by referring to the speed table and the periodic table, and rotation speeds of motors.

FIG. 6 shows one example of the corresponding relationship between the instructed speed Vm of each motor 7 and period T determined using the tables TB1 and TB2, and control of rotation speed of each motor 7 by the control device 20 (FIG. 3). In FIG. 6, it is assumed that the left stick 2*a* of the controller 2 is operated from the neutral position by a given amount, and the right stick 2*b* is held at the neutral position. In this case, the instructed speed Vm is determined according to the operation information of the left stick 2*a* included in a control signal sent from the controller 2 by referring to the speed table TB1, and the periodic table TB2 is referred to with respect to the instructed speed Vm to determine the period T. Thus, the control device 20 controls the motors 7 such that the left and right motors 7 repeat rotation at the instructed speed Vm and stop in a cycle of period T, and the left and right motors 7 rotate alternately. Although the time distributions of the rotation and the stop in the period T are equally set to T/2, the time distributions may be set in a manner other than this. When the instructed speed Vm is in the speed range H, the period T becomes 0. In this case, the control device 20 rotates the left and right motors 7 at the instructed speed Vm simultaneously.

Figure 7A:
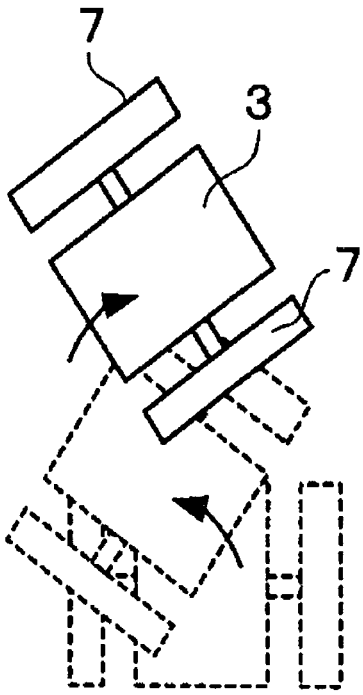
FIG. 7A shows a state in which the model moves forward when a control device controls the rotation of the motor in a speed range L.
Figure 7B:
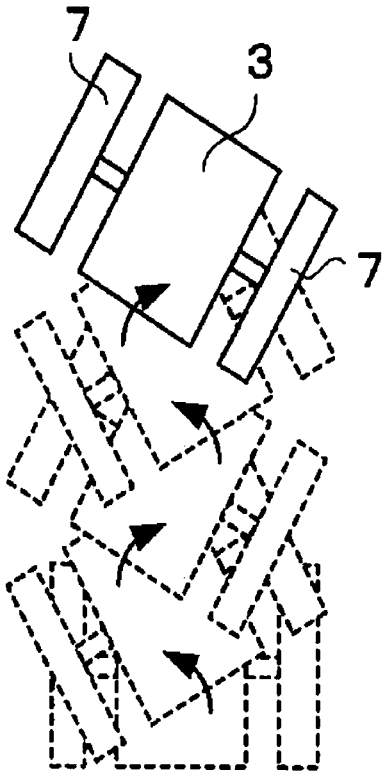
FIG. 7B shows a state in which the model moves forward when the control device controls the rotation of the motor in a speed range M.
Figure 7C:
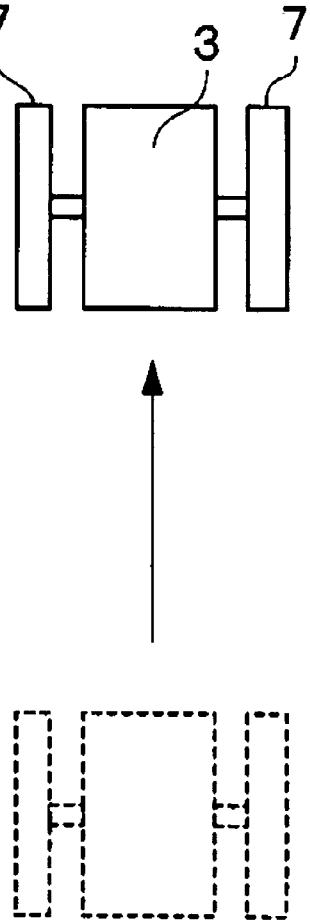
FIG. 7C shows a state in which the model moves forward when a control device controls the rotation of the motor in a speed range H.

FIGS. 7A, 7B and 7C show a state in which the model 3 moves forward when the rotations of the motors 7 are controlled in the above-described manner. FIG. 7A shows the state in which the instructed speed Vm is in the speed range L, FIG. 7B shows the state in which the instructed speed Vm is in the speed range M, and FIG. 7C shows the state in which the instructed speed Vm is in the speed range H. FIGS. 7A and 7B show a case where the right wheel is rotated first, but it is not always necessary to start driving the right wheel first. As shown in FIGS. 7A and 7B, when the motors 7 are rotated alternately, the model 3 moves forward such that the model 3 alternately turns around the stopped wheel. Therefore, although the running device 6 uses the wheels 8, it is possible to express as if the model 3 walks such that the model 3 alternately projects the two legs while swinging the body of the model 3 laterally.

As apparent from comparison between FIGS. 7A and 7B, if the instructed speed Vm increases and the speed range is shifted from the speed range L to the speed range M, the period T is reduced from T1 to T2, the swinging motion pitch of the model 3 in the lateral direction becomes shorter, and the angle through which the model 3 turns in a half period (T/2) is reduced. Therefore, the lateral swinging motion of the model 3 becomes small, and it is possible to express as if the model 3 is in a hurry as compared with the speed range L.

Since the rotation speed of the motor 7 in the speed range L is lower than that in the speed range M, the model 3 moves forward while largely and slowly swinging laterally in the speed range L, and the lateral swinging motion is repeated hurriedly and with smaller motion in the speed range M. Due to the combination of the difference between the turning angles and the difference between speeds, the characteristics of the two-leg-walking can be expressed more excellently.

If the instructed speed Vm increases to the speed range H, the alternate rotations of the motors 7 are stopped, the left and right motors 7 are driven at equal speed to move the model 3 straightly in the moving direction. Thus, it is possible to express a state in which the model 3 moves straightly toward a destination. Since the rotation speed of the motor 7 further increases in the speed range H, a state in which the model 3 run fast toward a destination can be expressed, and this is preferable.

Although the right stick 2*b* is held at the neutral position and the model 3 moves straightly in the above example, when the right stick 2*b* is operated in such a manner, the instructed speed Vm of the motor 7 corresponding to the inner wheel 8 may be reduced with a ratio which is in proportion to the operating amount of he right stick 2*b* from the neutral position with respect to the instructed speed given by the speed table TB1. The period T in this case, for both right and left motors 7, may be determined from the periodic table TB2 based on the instructed speed Vm of the motor 7 corresponding to the outer wheel 8.

Figure 8:
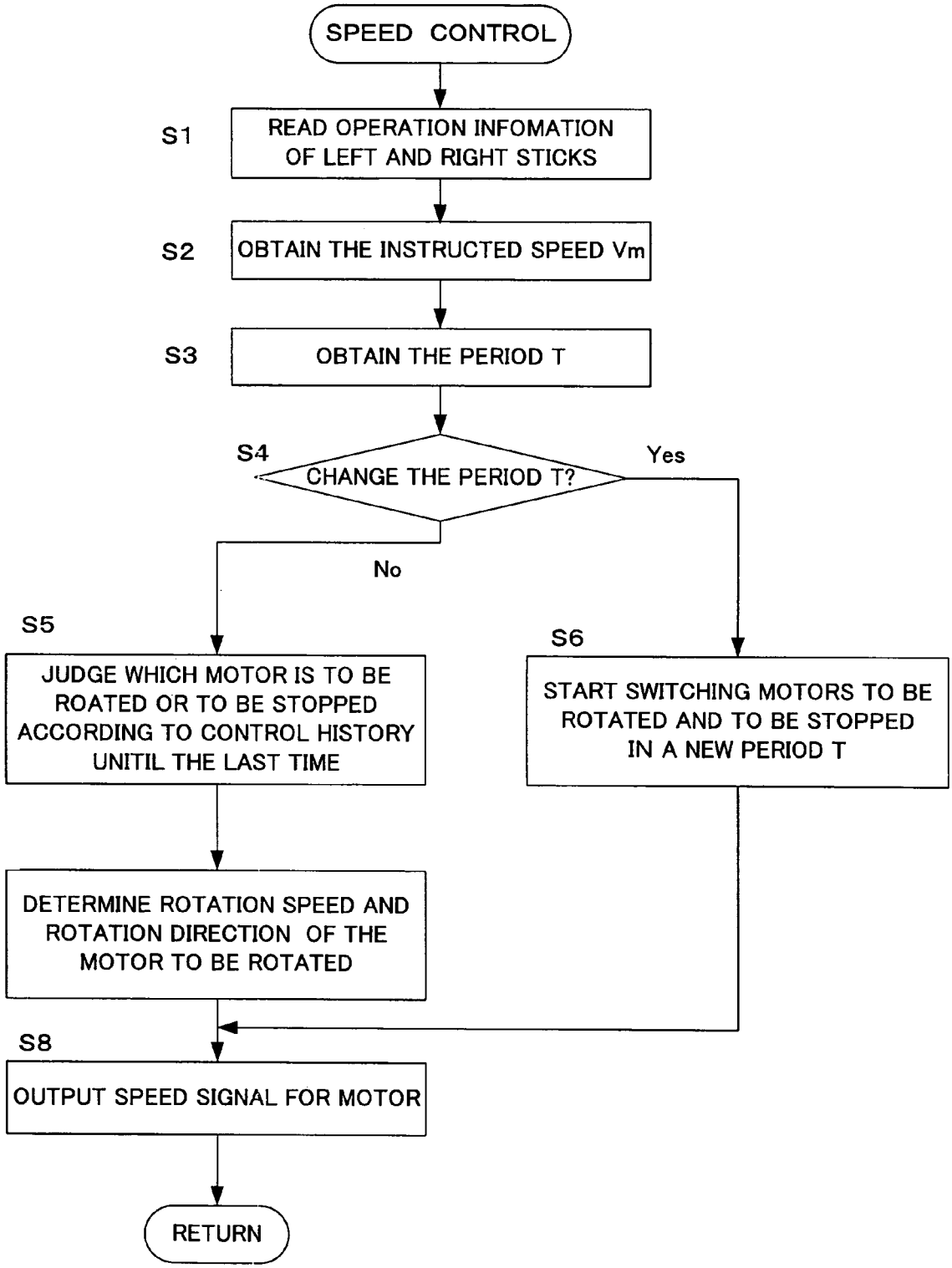
FIG. 8 is a flowchart showing a speed control routine which is carried out by the control device to control the driving operation of the motor.

FIG. 8 shows a speed control routine which is carried out by the control device 20 to control the driving operation of the motors 7 as described above. The control device 20 repeatedly carries out this speed control routine with given periods. In this speed control routine, in step S1, the control device 20 first receives a control signal from the receiving device 23 and reads the operation information of the left and right sticks 2*a* and 2*b* included in the control signal. In step S2, the control device 20 referrers to the speed table TB1 to obtain the instructed speed Vm which corresponds to the operating amount and the operating direction of the left stick 2*a*. In step S3, the control device 20 referrers to the periodic table TB2 to obtain the period T which corresponds to the instructed speed Vm.

Further, in step S4, the control device 20 judges whether the period T obtained in the current routine is changed with respect to the period T obtained in step S3 in the last routine. Since the control device 20 makes such a judgment, the control device 20 stores the instructed speed Vm, the period T and the speed signal sent to the each motor 7 determined in every carried out routine as control history in the RAM 22 for a predetermined period.

In step S4, if the period T is not changed, the procedure proceeds to step S5, and the control device 20 judges which one of the pair of motors 7 should be rotated or stopped according to the past control histories until the last history. If the time elapsed after the motor 7 to be rotated and the motor 7 to be stopped were switched last time is smaller than ½ of the period T, the motor 7 to be rotated and the motor 7 to be stopped may be determined in the same manner as the last routine. If the elapsed time reached ½ of the period T, the motors 7 to be rotated and to be stopped may be switched. If the period T is changed in step S4, the procedure proceeds to step S6 to start switching between the motor 7 to be rotated and the motor 7 to be stopped by a new period T. In this case, the motor 7 which is previously determined to be driven may be forcibly determined as a motor to be rotated, and the other motor 7 may be forcibly determined as a motor to be stopped, or a motor 7 being rotated at the moment may be determined as a motor to be rotated and the other motor 7 may be determined as a motor to be stopped. In steps S5 and S6, if the period T is 0, both motors 7 are determined as rotated ones.

After a motor 7 to be rotated and a motor 7 to be stopped are determined in steps S5 and S6, the procedure proceeds to step S7, and the control device 20 determines the rotation speed and the rotation direction of the motor 7 to be rotated. Here, when the right stick 2*b* is in the neutral position, a rotation speed corresponding to the instructed speed Vm is set, and when the right stick 2*b* is operated from the neutral position, a rotation speed is obtained by multiplying an instructed speed Vm by a speed reduction ratio (less than 1) of a ratio corresponding to the operating amount of the right stick 2*b*. The rotation direction may be determined according to the operating direction of the left stick 2*a*. After the rotation speed and the direction are determined in step S7, the control device 20 makes the procedure proceed to step S8. In step S8, the control device 20 outputs a speed signal indicative of the determined rotation speed and the rotation direction to the motor drivers 24 corresponding to the motor 7 to be rotated, and outputs a speed signal indicative of stop to the motor drivers 24 corresponding to the motor 7 to be stopped. Then, the current routine is completed.

The present invention is not limited to the above modes, and can be carried out in various modes. For example, the running device may include two or more pairs of wheels. In this case, driving operation of at least one pair of wheels may be controlled according to an embodiment of the present invention. The controller may determine the instructed speed based on the speed table. In such a case, information for specifying the instructed speed and direction of the motors is added to the control signal from the controller, and the control device on the side of the model may specify the actual rotation speed and the direction of each motor from the instructed speed and the direction. Although the speed range is divided into three stages, i.e., L, M and H in the above embodiment, either one of the speed ranges L and M may be omitted, or the speed range H may be omitted so that the running mode of the model 3 may be changed into two stages. On the contrary, the speed range may be divided into more than three stages, and especially the period T may be changed in stepless manner and continuously according to the magnitude of the instructed speed Vm.

The running device for a model can be applied not only to the remote control toy. For example, in the case of a self-propelled toy which runs according to a previously written program, left and right motors may alternately be rotated based on speed instructed according to the program in the same manner as the present invention. That is, the speed may be instructed from outside of the model or inside of the model.

The invention claimed is:

1. A running device for a model comprising:

a pair of motors;

a pair of left and right wheels which are independently driven by the pair of motors;

a driving control device which controls operations of the pair of motors respectively based on instructions concerning speed and direction; and a table in which a speed range and an operation of the pair of motors in association with each other wherein the table is set so that a low speed range is associated with an operation for automatically controlling each one of the pair of motors to be alternately and separately rotated for a period in an instructed direction, and a high speed range which is higher than the low speed range is associated with an operation for the pair of motors to be controlled to be rotated in an instructed direction simultaneously and the driving control device refers to the table to determine the operation associated with an instructed speed, and controls the pair of motors based on the determined operation.

2. The running device according to claim 1, wherein a period for switching rotations of the motors is set as the operation associated with the low speed range in the table so that as the instructed speed is changed from a low speed side to a high speed side in the low speed range the period becomes shorter.

3. The running device for a model according to claim 1, wherein as the instructed speed is higher, the driving control device increases the rotation speed of the motor being driven.

4. The remote control toy according to claim 1, wherein a period for switching rotations of the motors is set as the operation associated with the low speed range in the table so that as the instructed speed is changed from a low speed side to a high speed side in the low speed range the period becomes shorter.

5. A running device for a model comprising:

a pair of motors;

a pair of left and right wheels with are independently driven by the pair of motors;

a driving control device which controls operations of the pair of motors respectively based on instructions concerning speed and direction; and a table in which instructed speed and an operation of the pair of motors in association with each other, wherein a low speed range is associated with an operation for automatically controlling each one of the pair of motors to be alternately and separately rotated, wherein a period for switching rotations of the motors is set as the operation associated with the instructed speed in the table so that as the instructed speed is changed from a low speed side to a high speed side in the low speed range, the period becomes shorter, and the driving control device refers to the table to determine the operation associated with the instructed speed, and controls the pair of motors based on the determined operation.

6. The running device for a model according to claim 5, wherein as the instructed speed is higher, the driving control device increases the rotation speed of the motor being driven.

7. A model having the running device for a model according to claim 5, wherein the model is modeled after a two-leg-walking type organism or machine.

8. A model having a running device comprising:

a pair of motors;

a pair of left and right wheels which are independently driven by the pair of motors;

a driving control device which controls operations of the pair of motors respectively based on instructions concerning speed and direction; and a table in which a speed range and an operation of the pair of motors in association with each other wherein the model is modeled after a two-leg-walking type organism or machine1 the table is set so that a low speed range is associated with an operation for automatically controlling each one of the pair of motors to be alternately and separately rotated for a period in an instructed direction, and a high speed range which is higher than the low speed range is associated with an operation for the pair of motors to be controlled to be rotated in an instructed direction simultaneously; and the driving control device refers to the table to determine the operation associated with an instructed speed, and controls the pair of motors based on the determined operation.

9. A remote control toy comprising:

a controller for generating and sending a control signal corresponding to operation of a user; and a model having a running device to be controlled remotely based on the control signal, wherein the running device includes a pair of motors, a pair of left and right wheels which are independently driven by the pair of motors, and a driving control device which controls operations of the pair of motors respectively based on instructions concerning the speed and direction specified according to the control signal; and a table in which a speed range and an operation of the pair of motors in association with each other, wherein the table is set so that a low speed range is associated with an operation for automatically controlling each one of the pair of motors to be alternately and separately rotated in an instructed direction, and a high speed range which is higher than the low speed range is associated with an operation for the pair of motors to be controlled to be rotated in an instructed direction simultaneously; and the driving control device refers to the table to determine the operation associated with an instructed speed, and controls the pair of motors based on the determined operation.

10. The remote control toy according to claim 9, wherein as the instructed speed is higher, the driving control device increases the rotation speed of the motor being driven.

11. The remote control toy according to claim 9, wherein the model is modeled after a two-leg-walking type organism or machine.

12. A remote control toy comprising:

a controller for generating and sending a control signal corresponding to operation of a user; and a model having a running device to be controlled remotely based on the control signal, wherein the running device includes a pair of motors, a pair of left and right wheels which are independently driven by the pair of motors, a driving control device which controls operations of the pair of motors respectively based on instructions concerning the speed and direction specified according to the control signal; and a table in which instructed speed and an operation of the pair of motors in association with each other, wherein a low speed range is associated with an operation for automatically controlling each one of the pair of motors to be alternately and separately rotated, wherein a period for switching rotations of the motors is set as the operation associated with the instructed speed in the table so that as the instructed speed is changed from a low speed side to a high speed side in the low speed range, the period becomes shorter, and the driving control device refers to the table to determine the operation associated with the instructed speed, and controls the pair of motors based on the determined operation.

13. The remote control toy according to claim 12, wherein as the instructed speed is higher, the driving control device increases the rotation speed of the motor being driven.

14. The remote control toy according to claim 12, wherein the model is modeled after a two-leg-walking type organism or machine.

* * * * *

UNITED STATES PATENT AND TRADEMARK OFFICE

CERTIFICATE OF CORRECTION

PATENT NO. : 7,479,055 B2
APPLICATION NO. : 10/510187
DATED : January 20, 2009
INVENTOR(S) : Kazuyuki Saeki It is certified that error appears in the above-identified patent and that said Letters Patent is hereby corrected as shown below:

Title Page, Item (73) Assignee:

Please remove "Konami Corporation" and

Please insert -- Konami Digital Entertainment Co., Ltd. --

Signed and Sealed this

First Day of December, 2009

David J. Kappos

David J. Kappos
*Director of the United States Patent and Trademark Office*